US005095711A

United States Patent [19]

Marris et al.

[11] Patent Number: 5,095,711

[45] Date of Patent: Mar. 17, 1992

[54] METHOD AND APPARATUS FOR ENHANCEMENT OF HEAT PUMP DEFROST

[75] Inventors: Derrick A. Marris, Morresville; Ross K. Burnside, Speedway, both of Ind.

[73] Assignee: Carrier Corporation, Syracuse, N.Y.

[21] Appl. No.: 681,309

[22] Filed: Apr. 8, 1991

[51] Int. Cl.[5] ..... F25D 21/06

[52] U.S. Cl. ..... 62/81; 62/156; 62/160; 62/278; 62/324.5

[58] Field of Search ..... 62/428, 277, 278, 282, 62/186, 180, 181, 183, 184, 160, 324.5, 156, 155, 82, 81

[56] References Cited

U.S. PATENT DOCUMENTS 4,178,767 12/1979 Shaw ..... 62/324.5 X
4,554,968 11/1985 Haas ..... 62/324.5 X
4,951,473 8/1990 Levine et al. ..... 62/156 X

*Primary Examiner*—Harry B. Tanner

[57] ABSTRACT

A heat pump is provided with a reversible fan motor in its outdoor coil and, after a delay period following initiation of the defrost cycle, the fan is caused to operate in a reverse direction to thereby cause the surrounding air to flow through the outdoor coil in a direction opposite to that in which it flows during the heating mode operation. During this time, the fan is operated at a relative slow speed to thereby prevent the convective flow of heat upwardly, while at the same time causing little, if any, flow of ambient air downwardly into the coil.

10 Claims, 3 Drawing Sheets

METHOD AND APPARATUS FOR ENHANCEMENT OF HEAT PUMP DEFROST

BACKGROUND OF THE INVENTION

This invention relates generally to heat pump systems and, more particularly, to a method and apparatus for enhancing the process of defrosting the outdoor coil thereof.

In conventional heat pump system operation, when the system is operating in the heating mode with the outdoor coil acting as an evaporator, the formation of frost or ice on the heat exchanger is a common phenomenon. That is, under appropriate ambient conditions, the media in flowing heat transfer relationship with the evaporator, typically air, has its temperature lowered below its due point, thus causing condensation to form on the coil. If the ambient temperature conditions are sufficiently low, this condensation will then be caused to freeze. That is, since the heat pump operating in the heating mode requires the refrigerant to be at a lower temperature than the ambient air in order to transfer heat thereto by way of the outdoor coil, condensation, and eventually ice or frost, will tend to form on the coils even at ambient temperatures above the freezing point. Once this ice or frost coats the surface of the heat exchanger, the efficiency thereof is impaired, and overall system efficiency is decreased. Consequently it is desirable to maintain the evaporator surfaces free from ice or frost. A defrost cycle is therefore periodically used as a normal mode of operation for that purpose.

A conventional manner of defrosting the outdoor coil is that of reversing the refrigerant flow, such that the outdoor coil functions as a condenser with the hot gases that are discharged from the compressor being circulated directly to the outdoor coil to melt the ice that is formed thereon. During this process, the outdoor fan is normally shut off so that the exposure of the outdoor coils to the cooler ambient temperature of the air does not adversely effect the defrost cycle. While this does speed up the defrost process by inhibiting the flow of ambient air over the coil, it also allows the heat from both the coil and the compressor to flow upwardly by natural convection to be lost to the atmosphere.

It is therefore an object of the present invention to provide a heat pump with an improved defrost cycle.

Another object of the present invention is the provision in a heat pump system for inhibiting the loss of heat by convection during the defrost cycle.

Yet an other object of the present invention is the provision in a heat pump for reducing the time required for a defrost cycle.

Still another object of the present invention is the provision for a heat pump system which is economical to manufacture and economical and effective in use.

These objects and other features and advantages become more readily apparent upon reference to the following description when taken in conjunction with the appended drawings.

SUMMARY OF THE INVENTION

Briefly, in accordance with one aspect of the invention, provision is made in a heat pump operating in the defrost mode, for reversing the direction of rotation of the outdoor coil fan such that the heat that would otherwise be lost from the top by the way of convection is confined to the interior of the heat pump, thereby raising the ambient temperature around the outdoor coil to enhance the defrost process. In this way, the defrost cycle is shortened and the overall efficiency of the system is increased.

By yet another aspect of the invention, the method of defrosting an outdoor coil of a heat pump involves a first step of shutting off the fan of the outdoor coil when the defrost cycle is commenced. After the outdoor coil has been allowed to warm up to a predetermined temperature, the outdoor fan is turned on and caused to operate at a relatively slow speed in a reverse direction so as to impede the upward flow of warmer air surrounding the coil and the compressor and instead, causing that air to be confined to the interior of the heat pump, thereby raising the ambient temperature surrounding the outdoor coil to assist in the defrost process.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
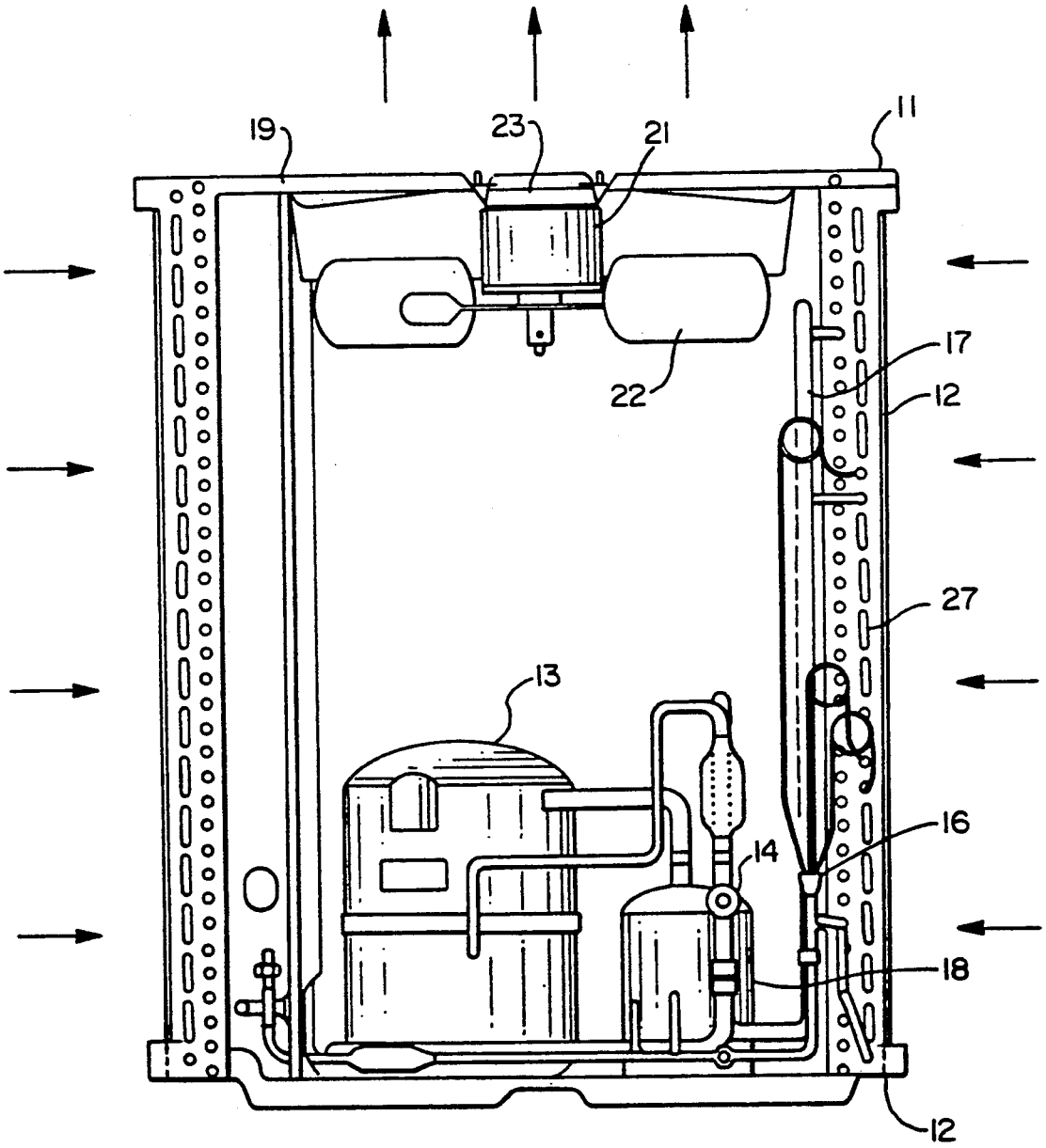
FIG. 1 is a pictorial representation of a heat pump having in the present invention incorporated therein.

Referring now to FIG. 1, there is shown a heat pump system 11 of the type with which the present invention is employed. It includes an outdoor coil 12 and a compressor 13 forming part of the refrigeration circuit, along with the indoor coil and refrigerant expansion device (not shown), as are found in a conventional system.

Also in a conventional manner a four way valve 14 provides the flexibility of the heat pump to be operated in either the heating or cooling mode by directing the refrigerant to the indoor or outdoor coils respectively. This valve also allows the system to operate in the defrost mode to direct the hot discharge gas to the outdoor coil.

Also forming part of the refrigeration circuit is the liquid distributor 16 and the vapor header 17. When operating in the heating mode, the liquid distributor 16 distributes the liquid refrigerant to the individual circuits of the outdoor coil 12 after it has passed through the expansion device, and the vapor header 17 is a common point at which all of the refrigerant passing through the outdoor coil is combined and passes to the reversing valve 14. In the cooling and defrost modes of operation, the liquid distributor 16 is the common point at which all of the refrigerant passing through the outdoor coil 12 is combined and directed to the indoor coil (not shown), and the vapor header 17 distributes the hot discharge gas to the individual circuits of the outdoor coil 12. Finally, also as part of the refrigeration circuit, an accumulator 18 is provided to store excess charge during the heating mode and to protect the compressor 18 from liquid slugging during startup.

Referring now to the components that are involved in causing the air to flow through the heat pump 11 by first drawing air radially inwardly through the outdoor coil 12 and then discharging it upwardly, there is provided a louvered top cover 19 from which there is suspended an outdoor fan motor 21 drivingly connected to an outdoor fan propeller 22. In operation during both the cooling and heating modes, the motor 21 drives the fan propeller 22 in such a manner as to draw the ambient air radially inwardly through the outdoor coil 12 and discharge it upwardly as shown by the arrows in FIG. 1.

During operation in the heating mode, wherein the outdoor coil 12 is functioning as an evaporator to absorb heat from the outdoor air, there is a tendency for frost to form on the fins of the outdoor coil 12, thus causing a eduction in heat transfer efficiency. The system is then periodically run in a defrost mode (i.e. with the outdoor coil 12 functioning as a condensing coil) to remove the frost from the coil. Rather than leaving the fan motor 21 off when operating in this mode, as is the conventional manner, the motor 21 is caused to run in the opposite direction in a manner to be described hereinafter for the purpose of enhancing the defrost process. In order to effect this function, it is necessary to employ a reversible motor, such as an electrically commutated motor (ECM) commercially available from General Electric Company. It is also convenient to have an integrated control 23 incorporated into the motor 21 such that the direction and speed of the motor 21 can be controlled as a function of sensed parameters and conditions as will be described hereinafter. For example, one may include specially designed micro-circuitry into an ECM motor such that operation of the fan motor 21 is entirely controlled by such micro-circuitry. Alternatively, one may provide a discrete control circuitry with inputs going to the motor 21 by way of electrical leads.

Figure 2:
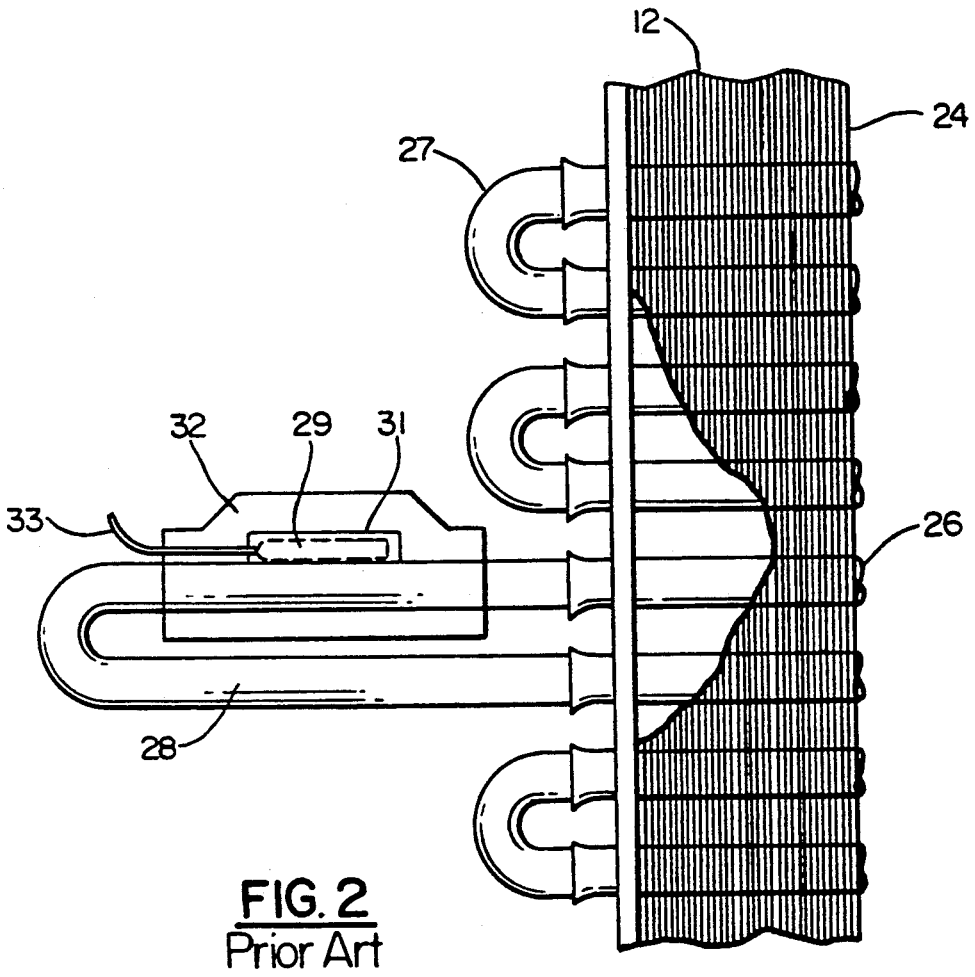
FIG. 2 Prior Art
FIG. 2 is a partial view of the outdoor coil portion thereof, together with an installed thermistor.

Referring now to FIG. 2, a portion of the outdoor coil 12 is shown in greater detail to include a conventional arrangement of plate fins 24, tubes 26, and return bends 27. In order to employ the enhanced defrost mode in accordance with the present invention, it is desirable to monitor the temperature of the outdoor coil. For that purpose, a standard outdoor coil is modified as shown in FIG. 2.

At some point in the outdoor coil 12, and preferably in the middle of the bottom circuit thereof, a standard return bend 27 is replaced with an extended return bend 28 which allows for the sensing of the temperature in the coil. For that purpose, a thermistor 29 is placed in direct contact with the outer surface of the extended return bend 28 and is held in place by a copper sleeve 31 which is preferably braised to the extended return bend 28. The copper sleeves/thermistor combination is then surrounded by insulation 32 in order to provide the thermal isolation necessary for ensuring the desired thermal response of the thermistor 29. Thermistor leads 33 are provided to transmit the electric signals representative of resistance change in the thermistor back to the system control 23.

Figure 3:
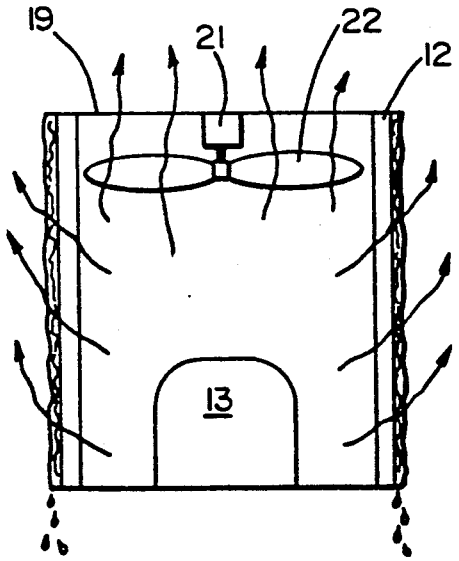
FIG. 3 is a an elevational view of a conventional heat pump, showing the direction of air flow therethrough during the defrost cycle.

Considering now what occurs during the course of a conventional defrost cycle, it will be seen in FIG. 3 that, as the heat tends to build up in the compressor 13 and the outdoor coil 12, it tends to rise by convection and pass through the louvered top cover 19 to be lost to the atmosphere. During this time, since the fan 22 is normally shut off for the defrost cycle it does nothing to either enhance or inhibit this flow.

Figure 4:
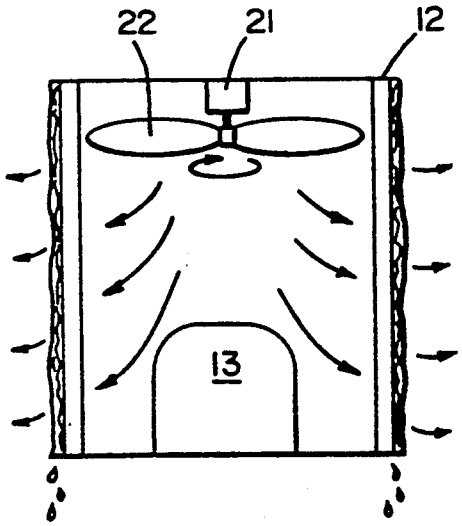
FIG. 4 is an elevational view of a heat pump in accordance with the present invention, showing the direction of air flow therethrough during the defrost cycle.

In accordance with the present invention, the fan motor/propeller combination is applied to increase the efficiency of the system by eliminating these convective losses from the top of the unit. In operation, when a system shifts from the heating mode to the defrost mode, the fan 22 is shut off as is done in the conventional manner. However, when the temperature of the outdoor coil 12, as determined by the thermistor 29, reaches a predetermined temperature (e.g. 32° F.), then the integrated motor control 23 is responsively energized in the reverse direction at a relatively slow speed (e.g. 20–50 RPM). This in turn creates a positive pressure at the top of the unit and prevents the upward convective flow of heat. As will be seen in FIG. 4, the air that would normally rise is forced to flow radially outwardly and pass through the coil to thereby enhance the defrost process. When the temperature of the coil, as determined by the thermistor 29, reaches a predetermined temperature (e.g. 65°–80° F.) then the defrost cycle will be terminated by the integrated control 23.

Figure 5:
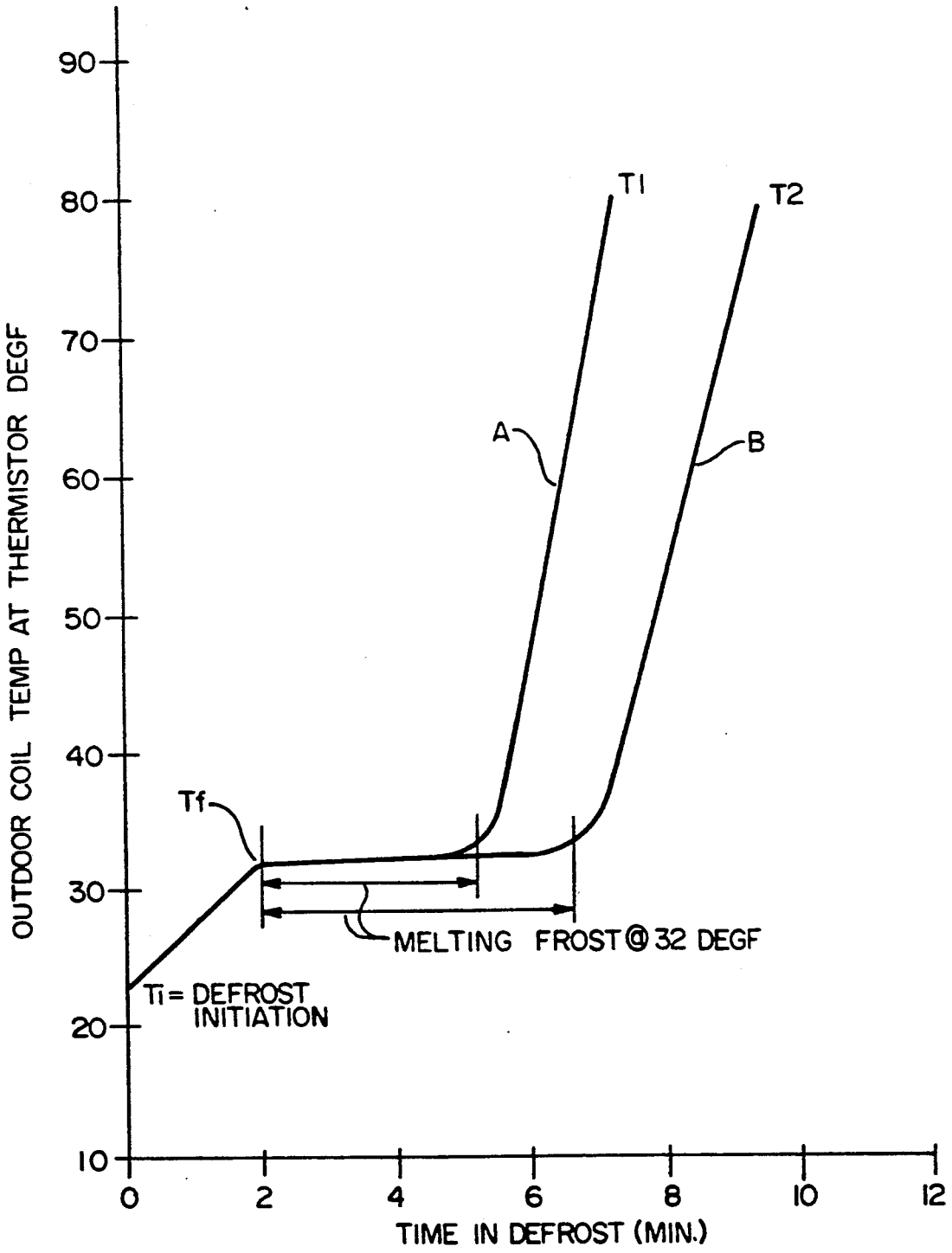
FIG. 5 is a graphic illustration of the outdoor coil temperature during defrost as a function of time as it is effected by the present invention.

In FIG. 5 there is shown a graphic illustration of the outdoor coil temperature as a function of time during typical defrost cycles with and without the present invention employed. Curve A shows the performance with use of a reversible fan operation in accordance with the present invention, and curve B shows the performance of the same system without that feature. In either case, defrost initiation is commenced at an outdoor coil temperature of Ti. With the outdoor fan motor 21 off and the outdoor coil 12 functioning as an evaporator coil, the coil temperature rises to a temperature of Tf. At this point, with the present invention applied as represented by curve A, the outdoor fan is turned on at a slow speed in a counter clockwise direction to inhibit the convection phenomenon. The coil temperature stays relatively constant while the frost is melting off the coil. When all of the frost is melted, the temperature of the coil rises rapidly until the defrost is terminated at $T_1$.

In operation without the reversible fan feature as represented by curve B, the fan is left off when the coil temperature reaches Tf, and the heat is allowed to escape through the top cover in the conventional manner. Again, the coil temperature remains relatively constant while the frost is melting off the coil. But the time required to melt the frost from the coil is increased substantially because of the heat loss through the louver top. When all of the frost is melted, the temperature again rises rapidly, but not as rapidly as in curve A because of the heat that has been lost. The total time of defrost, $T_2$ is therefore substantially greater than the time $T_1$ for curve A. That is, with the present invention incorporated, the total defrost time is on the order of 7 minutes, whereas, without it, the total time for defrost is upwards of 9 minutes in this example.

While the present invention has been disclosed with particular reference to preferred embodiments thereof, the concepts of this invention are readily adaptable to other embodiments, and those skilled in the art may vary the structure and method thereof without departing from the essential spirit of the invention. Thus, while other variations will occur to those skilled in the art, it is contemplated that such variations are within the scope of the appended claims.

What is claimed;

1. An improved heat pump system of the type having outdoor and indoor heat exchange coils with associated fans, a compressor, an expansion device, and means for reversing the flow of refrigerant for purposes of selecting between heating, cooling, and defrost modes of operation, wherein the improvement comprises;

reversible drive means for driving the outdoor fan; and control means for selectively reversing said reversible drive means during periods in which the system is operating in the defrost mode, such the heated air from the outdoor coil defrost is confined to the interior of the heat pump, thereby raising the ambient temperature surrounding the outdoor coil.

2. An improved heat pump system as set forth in claim 1 wherein said control means includes a delay means for delaying the operation of said reversible drive means in the reverse direction until the outdoor coil is allowed to warm up to a predetermined temperature after commencement of the defrost mode of operation.

3. An improved heat pump as set forth in claim 1 wherein said reversible drive means is capable of operating at more than one speed, and further wherein its speed for operation in the reverse direction is substantially slower than that in which it operates during the heating mode of operation.

4. An improved heat pump system as set forth in claim 1 wherein said outdoor fan is located near the top of the outdoor coil and further wherein the fan causes ambient air to flow radially inwardly through the outdoor coil during operation in the heating mode, and for heated air to be confined to the interior of the heat pump during operation in the defrost mode of operation.

5. An improved heat pump system as set forth in claim 1 wherein the outdoor fan is of the propeller type and is located near the top of the outdoor coil.

6. An improved heat pump as set forth in claim 1 wherein the compressor is centrally located at the lower end of the outdoor coil.

7. An improved heat pump system as set forth in claim 1 wherein said reversible drive means comprises an electronically commutated motor.

8. An improved method of operating a heat pump system of the type having an outdoor coil with a fan for causing ambient air to flow therethrough, and means for reversing the flow of refrigerant in the system to change from a heating mode to a defrost mode of operation, comprising the steps of: determining when the system is operating in the defrost mode; and responsively causing the outdoor coil fan to rotate in the direction opposite to that in which it operates during the heating mode to thereby prevent the convective flow of heat upwardly, while at the same time causing little, if any, flow of ambient air downwardly into the outdoor coil.

9. A method of operation as set forth in claim 8 when said step of causing reverse directional rotation is accomplished by causing the fan to rotate at a speed substantially slower than that in which is operates during the heating mode.

10. A method of operating as set forth in claim 8 and including an intermediate step of delaying, after the step of determining when the system is operating in the defrost mode, such that the outdoor coil has an opportunity to warm up before the outdoor coil fan is turned on.

* * * * *